United States Patent [19]

Stephenson et al.

[11] Patent Number: 4,648,803

[45] Date of Patent: Mar. 10, 1987

[54] CONTROL CIRCUIT AND CONTROL VALVE FOR RADIAL PISTON PUMP

[75] Inventors: Dwight B. Stephenson, Hudson; Glenn R. Wendel, Gilbertville, both of Iowa

[73] Assignee: Deere & Company, Moline, Ill.

[21] Appl. No.: 779,368

[22] Filed: Sep. 17, 1985

[51] Int. Cl.[4] ..... F04B 49/00

[52] U.S. Cl. ..... 417/53; 417/214

[58] Field of Search ..... 417/212, 213, 214, 221, 417/53; 60/452

[56] References Cited

U.S. PATENT DOCUMENTS

| | | | |
|---|---|---|---|
| 3,002,462 | 10/1961 | Raymond | 417/214 |
| 3,526,468 | 9/1970 | Moon et al. | 417/214 |
| 3,738,111 | 6/1973 | Fletcher | 60/452 |
| 3,985,472 | 10/1976 | Virtue et al. | 417/216 |
| 3,995,973 | 12/1976 | Ring et al. | 417/214 |
| 4,196,588 | 4/1980 | Johnson | 60/452 X |
| 4,498,846 | 2/1985 | Gassman | 417/214 |

*Primary Examiner*—Louis J. Casaregola
*Assistant Examiner*—Paul F. Neils

[57] ABSTRACT

A control circuit for a radial piston pump that uses a four position control valve and an orifice to regulate fluid flow from the stroke control chamber to the pump inlet. The control valve also regulates the addition of high pressure fluid for destroking the pump and provides pressure relief of the pump output during destroking to eliminate pressure spikes. Elimination of pressure spikes is done by an overshoot function which relieves high pressure output fluid directly to the pump inlet and to the pump control chamber while also venting the pump control chamber to the pump inlet. V-notch openings in the control valve for regulating the addition of high pressure fluid to the stroke control chamber enhance control during steady state operations. The circuit also uses a down sized orifice between the stroke control chamber and the pump inlet which allows a portion of the pump destroking phase to be done by piston leakage flow, thereby minimizing control fluid usage.

18 Claims, 6 Drawing Figures

CONTROL CIRCUIT AND CONTROL VALVE FOR RADIAL PISTON PUMP

BACKGROUND OF THE INVENTION

1. Field of the Invention

This invention relates to a stroke control circuit for a variable displacement reciprocating piston pump where the pump is destroked by increasing the pressure in the pump crank case to directly bias the radial pistons and, in particular, to a valve and orifice for controlling a radial piston pump.

2. Description of the Prior Art

The displacement of a radial piston pump is controlled by regulating the fluid pressure in its stroke control chamber or crankcase. This concept is taught in U.S. Pat. No. 3,002,462 issued to Raymond. As explained in the Raymond patent, increasing the pressure in the crankcase will destroke the piston and reduce displacement of the pump. Numerous methods for controlling the addition or withdrawal of pressurized fluid from the crankcase are disclosed in the prior art. U.S. Pat. No. 3,002,462 shows several arrangements for routing high pressure oil from the output of the pump through restriction orifices and back to the crankcase for destroking the pump in response to pump output and pressure drop through the restriction orifices. U.S. Pat. No. 3,526,468 issued to Moon shows a circuit for controlling the stroke in one pump of a two pump circuit using pump outlet pressure or pump inlet pressure regulated by a control valve. Although these and other control systems enable the pump to operate, the arrangement and function of the radial piston pump provides difficulties that detract from its operation and are not compensated for by known control circuits.

These control problems stem from the arrangement and characteristics of the radial piston pump. Controlling displacement of the pump by decreasing or increasing the pressure in the pump crank case to bias the radial pistons inward or outward and effect stroking or destroking increases the difficulty of control since it varies the capacitance of the stroke control chamber or crankcase. This variation in capacitance makes control nonlinear. In addition, response time to control signals is delayed by the amount of time necessary for the eccentric drive of the pump to push the pistons out after an increase in chamber pressure. Aside from the delay, pushing the pistons out to destroke the pump causes pressure spikes in the pump output. Finally, leakage from the piston chambers to the crankcase is usually high when the pump is at maximum power conditions. Thus the control system typically has an orifice for relieving crankcase pressure which is sized on the basis of the high leakage conditions at maximum power output. This results in a large energy loss at low power or standby conditions when a high quantity of control flow is needed to compensate for the low piston leakage at reduced power conditions.

Accordingly, it is an object of this invention to provide a control circuit that will reduce the detrimental effects of the stroking-destroking nonlinearity and destroking delay.

It is a further object of this invention to provide a control circuit that will limit spikes in output pressure when destroking of the pump.

Another object of this invention is to provide a control circuit minimizing energy loss.

SUMMARY OF THE INVENTION

These and other objectives of the invention are achieved by use of a control circuit which regulates pump output, stroke control chamber pressure and fluid flow into or out of the stroke control chamber. The nonlinearity and destroking delay are overcome by the use of a valve having V-notch openings for regulating the flow of high pressure oil into the stroke control chamber of the pump. V-notches provide a low flow area gain for control stability at steady state operating conditions and a high flow area gain for transient or rapidly changing operating conditions. A highly effective relief mode or overshoot function which connects the output of high pressure oil and the stroke control chamber with the low pressure oil inlet is also incorporated in the circuit to reduce pressure spikes during destroking. In addition, the circuit contains a downsized restriction orifice for relieving pressure from the stroke control chamber which allows piston leakage from the pump to perform a portion of the destroking function when the flow of high pressure oil into the stroke control chamber is blocked. Additional details and embodiments of this invention are set forth in the following detailed description.

DETAILED DESCRIPTION

Figure 1:
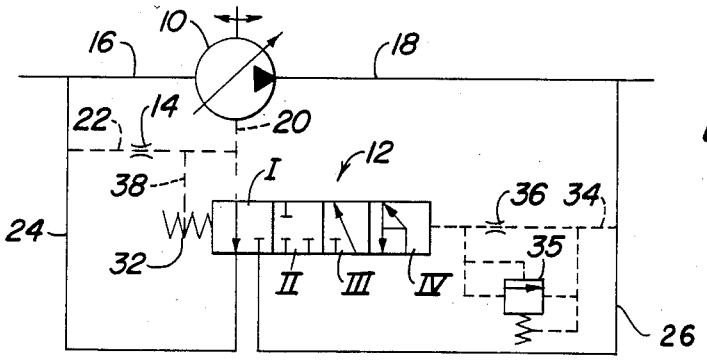
FIG. 1 is a schematic diagram of the pump control circuit and a control valve incorporated therein.

The hydraulic circuit of this invention is shown in FIG. 1 containing a variable displacement reciprocating piston pump 10, a control valve 12 and a crankcase orifice 14. Pump 10 receives fluid from an inlet line 16. Fluid may enter the pump under gravity flow or be charged to the pump by an additional charge pump. The pump is driven by a prime mover (not shown) which causes the pump to deliver pressurized fluid through outlet line 18. The volume of fluid delivered by the pump is regulated by the volume and pressure of fluid in its crankcase (not shown) which acts as a stroke control chamber. The pump is stroked by increasing fluid pressure in the stroke control chamber to directly bias the radial pistons and decrease their displacement. Stroke control line 20 communicates fluid to or from the crankcase. Additional details of the pump and the method of control can be obtained from U.S. Pat. No. 3,002,462 issued to Raymond, the teachings of which are herein incorporated by reference.

Orifice 14 is placed across an orifice line 22 which is connected to stroke control line 20 at one end and inlet line 16, via a control valve inlet line 24 at its opposite end.

FIG. 1 shows control valve 12 in schematic form. The control valve is connected on one side to the stroke control line 20 and on its opposite side to inlet line 24 and an outlet control valve line 26. In its preferred form, valve 12 has four positions labeled I–IV on its schematic representation. Position I is a meter out mode regulating fluid flow from stroke control line 20 to valve inlet line 24 and blocking fluid flow from valve line 26. Position II represents piston leakage control where all flow through the valve is blocked. A meter in mode is represented by position III wherein valve outlet line 26 is connected across a variable orifice to strike control line 20 and fluid flow is blocked from valve inlet line 24. Lastly, position IV provides the overshoot function of the control circuit in which valve outlet line 26 is connected to control chamber line 20 and valve inlet line 24 while stroke control line 20 is also connected to valve inlet line 24. A spring 32 biasses the control valve towards position I. High pressure from the pump outlet is communicated to the valve by control line 34 which supplies fluid pressure acting against spring 32 to move the valve progressively from the first through the fourth positions in response to increasing pressure at the pump outlet. Response of the valve to high pressure input is damped by the orifice 36 positioned across line 34. When the pressure differential across orifice 34 exceeds a predetermined value, a relief valve 35, positioned across line 34 opens to allow a rapid release of fluid pressure acting against spring 32. Additional force proportional to the pressure in the crankcase supplements the force of biassing element 32 and is communicated to the control valve by a crankcase pressure line 38. In the alternative line 38 could be connected to line 24 to supplement the biasing force of element 32 in proportion to inlet pressure.

Figure 2:
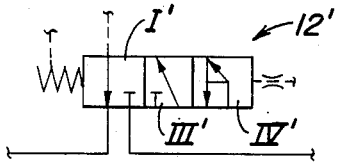
FIG. 2 is an alternate schematic arrangement for the control valve of FIG. 1.

A simplified form of the control valve is shown in FIG. 2 and labeled 12'. Control valve 12' only differs from control valve 12 of FIG. 1 in that position II has been eliminated. As a result, valve 12' does not have a complete blockage position.

Figure 3:
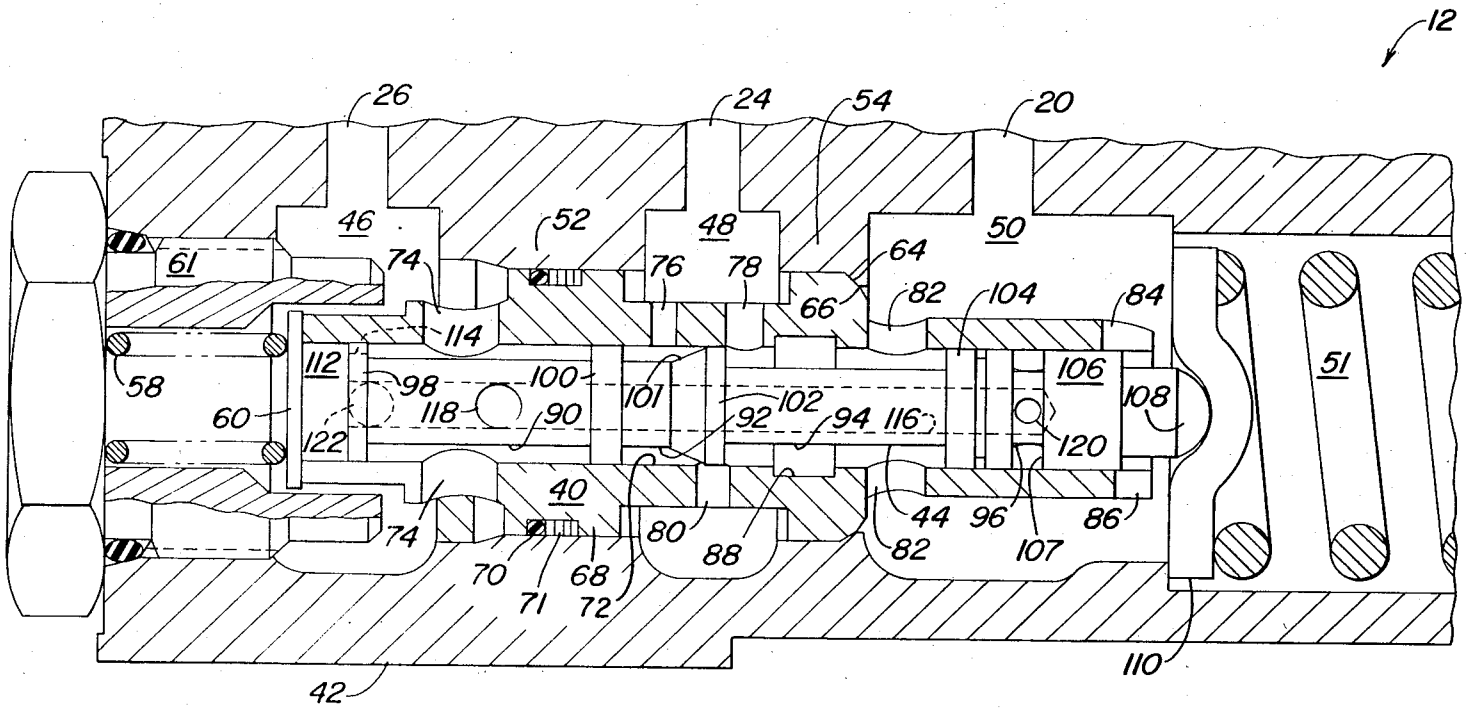
FIG. 3 is a section of a detailed arrangement for the control valve of FIG. 1.

An actual configuration of control valve 12 having all four positions is shown in FIG. 3. The control valve consists of a sleeve 40 positioned in a housing 42 with the sleeve having a spool 44 located therein.

The interior of valve housing 42 has an outlet chamber 46, an inlet chamber 48 and a crankcase chamber 50 separated by partitions 52 and 54. Chambers 46, 48 and 50 are in respective communication with the outlet line 26, the inlet line 24 and the stroke control line 20. The inner edges of partitions 52 and 54 serve to position sleeve 40 within the housing 42. A doubled beveled contact surface 64 on sleeve 40 is held against a contact surface 66 on the inner edge of partition 54 by a spring 58 which exerts a rightward force on the spool through contact member 60. Spring 58 acts against an end cap 61 which also closes the left end of the housing 42. The combination of partition 54, spring 58 and contact member 60 can be viewed as holding sleeve 40 rigidly in place within the housing. An annular ledge 68 on sleeve 40 holds an O ring 70 and a back-up ring 71 which contacts the inner surface of partition 52 to block fluid communication between chambers 46 and 48.

Figure 4:
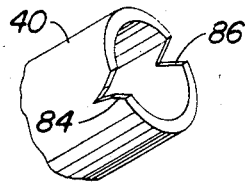
FIG. 4 further illustrates V-notch openings of the control valve of FIG. 3.

On its interior, sleeve 40 has an internal bore 72. Outlet ports 74 communicate bore 72 with chamber 46. Inlet chamber 48 communicates with internal bore 72 through a relief port 76, a meter out port 78 and a supply port 80. Fluid communication between crankcase chamber 50 and internal bore 72 is provided by crankcase ports 82, a deep V-notch opening 84, and a shallow V-notch opening 86. Bore 72, with the exception of an annular groove 88 located towards its midportion, has a smooth, uniform diameter. The configuration of V-notches 84 and 86 can be seen more clearly in FIG. 4 which shows the extreme right portion of sleeve 40.

Slidably disposed within internal bore 72 is spool 44. On the periphery of spool 44 are annular grooves 90, 92, 94 and 96. Annular groove 90 is defined by end land 98 and outlet land 100 and serves as an output pressure groove which communicates at all times with port 74. Groove 92 is an inlet pressure groove defined by inlet land 100 and ramped land 102. Groove 94 is a crankcase pressure groove defined by land 102 and a double land 104. Port 82 is positioned over groove 94 at all times. Groove 96 is defined by double land 104 and notch land 106. Spool valve 44 is movable within bore 72 and biassed to the left by spring 51, located in crankcase chamber 50, which transmits force to the right end 108 of the spool through a contact plate 110. Spring 51 acts against an end cap for chamber 50 (not shown) at its right end. At the opposite end of the spool, end land 98 together with the surface of bore 72 and contact member 60 define a pressure chamber 112. Pump output pressure is communicated from groove 90 across a square orifice 114 in end land 98 to chamber 112. (Orifice 114 corresponds to orifice 32 in FIG. 1.) Pressure in chamber 112 urges the spool rightward against spring 51. The center of spool 44 contains a blind bore 116. Fluid communication between grooves 90 and 96 is established through bore 116 via a high pressure port 118 communicating with groove 90 and a notch port 120 communicating with groove 96. The right end of bore 116 is closed by a sealing ball 122.

OPERATION

The location of the spool corresponding to different operation positions of the valve will be described in conjunction with the overall description of the control circuit operation. Operation of the control circuit will also be explained in conjunction with FIG. 5 which is a graph of fluid flow through the control valve versus the movement of spool 44 over its full functional range.

Figure 5:
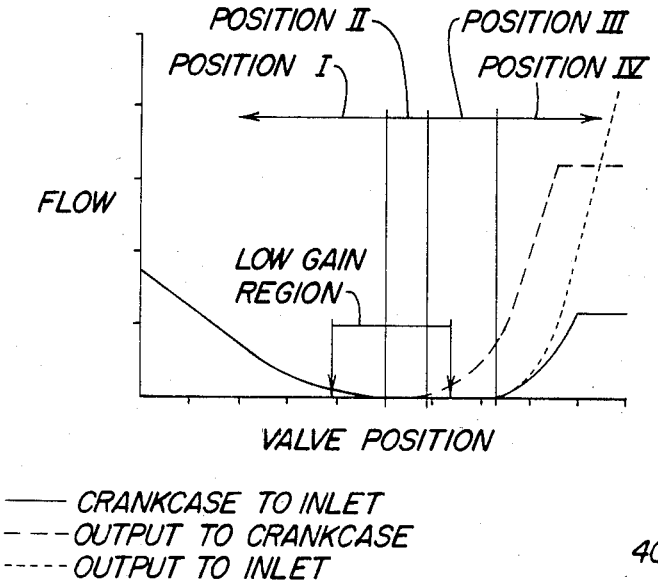
FIG. 5 is a graph of fluid flow through the control valve versus spool position for the valve of FIG. 3.

Starting then at the left end of FIG. 5, the circuit is in a high output condition wherein pump 10 delivers a high volume of fluid at relatively low output pressure. This low pressure is communicated to chamber 112 from line 26 via orifice 114, port 74 and chamber 46. Due to the low output pressure, spool 44 is biassed by spring 51 to a leftward position as shown in FIG. 3 which corresponds to position I. Fluid pressure in chamber 50 also acts on the right end of spool 44 providing additional rightward force on the spool contributing to the force of spring 51. Thus spring force and pressure acting in chambers 112 and 50 determine the positioning of the spool during operation of the control circuit. During this low pressure condition, land 102 remains completely to the left of meter output port 78 and partially to the left of supply port 80. This position allows fluid to be metered out of the crankcase through line 20 via chamber 50, ports 82 and groove 94. The source of fluid being metered out of the crankcase is either piston leakage or the displacement of oil by the pistons during destroking. In addition to fluid flowing from the crankcase across the valve, fluid also flows across orifice 14 back to the inlet of the pump. Thus the stroke control chamber is at its lowest pressure condition and the pump is fully stroked to supply the maximum volume of fluid to output line 18. The leftward position of the valve also causes notch land 106 to block the flow of output fluid from groove 90, through internal bore 116, into groove 96 and across V-notch 84.

With increasing pressure in output line 18, fluid pressure increases in pressure chamber 112 urging the valve to the right. Increasing rightward movement of the valve restricts venting of the stroke control chamber through ports 80 and 78 and across groove 94. The restriction in flow together with increasing piston leakage in the valve raises the pressure drop across the valve and orifice 14, thereby increasing the pressure in the stroke control chamber of the pump. At some point, rightward movement of the valve under the influence of increasing pressure at the pump outlet will cause land 102 to block supply port 80 from communication with groove 94 and meter out port 78 will be partially covered by land 102. The small flow area between port 78 and groove 94 allows very precise control of the flow rate through the valve and the spool enters the low gain region indicated on FIG. 5.

With a sufficient increase in output pressure, the spool moves rightward positioning land 102 immediately to the right of port 78. At the same time, land 106 still covers V-notch 84. Therefore fluid flow out of the stroke control chamber across the valve is blocked as the valve moves from position I to position II. This spool position is also indicated as the zero flow region on FIG. 5. Once the valve is blocked, all piston leakage into the crankcase passes through orifice 14 with the resulting pressure drop causing further destroking of the pump. By sizing orifice 14 such that piston leakage alone through the orifice will supply the necessary pressure drop for destroking the pump over a portion of the control valve range, the total control flow through the pump is minimized. Minimizing the use of control fluid conserves energy usage in the control circuit. Since the energy used in the control circuit does not contribute to the output of the pump, any decrease in its consumption raises the efficiency of the total pump system. In terms of total spool movement, the available travel over which valve flow to the stroke control chamber is blocked appears relatively small. However, this condition corresponds roughly to the center portion of the low flow gain region. Since the low gain region can be equated with the steady state operating zone, the spool is likely to occupy the zero flow region for a significant amount of its operating time. Therefore, position I can contribute a substantial energy savings to the circuit.

Figure 6:
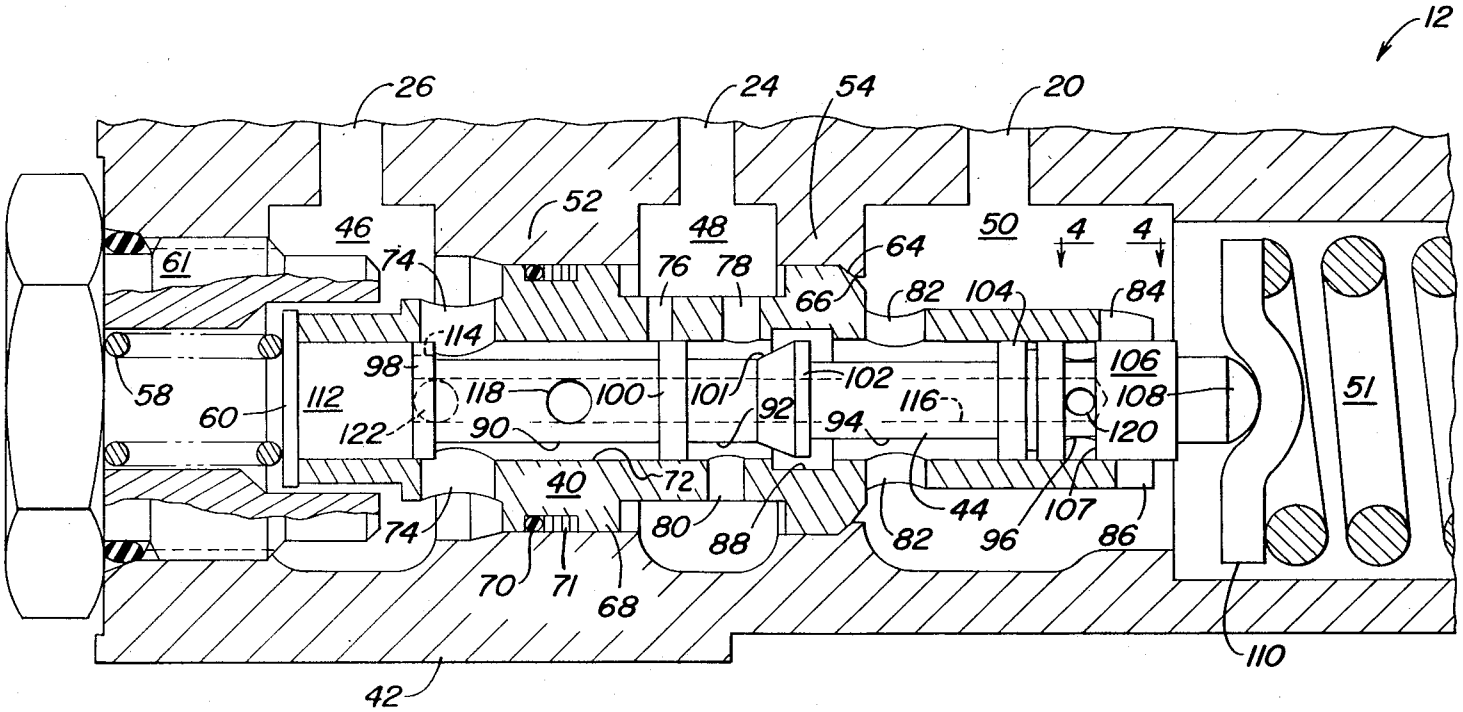
FIG. 6 shows the control valve of FIG. 3 with its valve spool in a different position.

A further increase in output pressure will move the valve to a meter in position previously referred to as position III. In this position, as shown in FIG. 6, inner edge 107 of land 106 moves to the right of the apex of V-notch 84. This movement opens groove 96 to communicate high pressure fluid from the output of the pump into the crankcase chamber 50 which is ultimately communicated to the stroke control chamber. Increased pressure in the stroke control chamber will further destroke the pump and reduce its displacement. The cooperation of land 106 with the V-notch offers precise control of fluid flow into the stroke control chamber. Although the same degree of control could be achieved using a small number of orifices, the V-notch has a self-cleaning action which avoids the plugging problems which are likely to result from the use of small orifices. Further destroking of the pump will be effected by additional rightward movement of the spool. It may be noted that in position IV, pump output pressure contributes to the force developed on equal areas at the left and right ends of the spool in chamber 112 and 50 respectively. However, orifice 14 (see FIG. 1) continually drains fluid from chamber 50 via line 20. Thus, pressure in chamber 112 exceeds the pressure in chamber 50 and the force of spring 51 so that rightward movement of the spool can continue in position III until land 102 moves past the left edge of annular groove 88.

It has been found that piston leakage may be used to perform the final stages of pump destroking thereby eliminating the need for position III. Nevertheless, it was also discovered that control circuit stability is improved by including a position III and sizing orifice 14 accordingly.

As spool 44 moves to the extreme rightward limit of position III, the valve is no longer in a steady state of operation which corresponds roughly with the low gain region indicated on FIG. 5. For the sake of simplicity, the rightward advance of the valve spool has been described as one of progressive movement, however, increases in pressure may cause the spool to jump back or forth in response to changes in pressure before coming to a steady state position incrementally to the right or the left of its previous position. Referring then again to FIG. 5, the pressure surge resulting from a destroking command will usually move the spool out of position III and briefly into position IV, shown in FIG. 6, which is represented by the far right side of FIG. 5.

The function of position IV can be more fully understood by considering in detail the reaction of the valve and pump on a destroking command. Upon receiving a signal that pressure has increased in the output line, the valve spool shifts rightward as previously discussed. Although shifting the spool rightward has increased pressure in the crankcase, this increase in pressure alone is not sufficient to drive the pistons out of the piston chambers. The pistons will not be moved until the mechanical means for pushing the pistons consisting of an eccentric driver contacts each piston and drives it out of the piston chamber. Driving the piston out of the chamber causes a momentary increase in pressure or a pressure spike at the outlet of the pump. When a pressure spike is encountered, the inherent high pressure causes the spool to shoot rightward past position III in position IV or the overshoot position. In this position, the left edge of land 100 moves past relief port 76 so that high pressure is relieved directly to inlet. At the same time, edge 107 of notch land 106 moves rightwardly past shallow V-notch 86, allowing a large volume of output oil to be vented into crankcase chamber 50. The additional fluid flow into crankcase chamber 50 flows outward to ports 80 and 78 over land 102 which is now positioned within annular groove 88. The ramped portion 101 of land 102 controls fluid flow from the crankcase chamber to the inlet chamber during overshoot while the cooperation of land 106 with both V-notches 84 and 86 regulates the flow of high pressure oil into crankcase chamber 50 during the overshoot function. Precise control and the ability to handle relatively large volumes of fluid allows the overshoot function to quickly return the valve to a steady state position. The slope of ramp 101 is chosen such that there is always more flow metering into the crankcase than can be relieved by ramp 101 at a steady state condition. This arrangement of ramp 101 prevents the valve from assuming a point of flow equilibrium in Region IV.

Erratic movement or oscillation of spool 44 during steady state or transient conditions is inhibited by the damping action of pressure chamber 112 and the orifice passage 114. Orifice 114 restricts the flow of high pressure fluid from groove 90 during transient pressure spikes to prevent overcompensation of the valve and subsequent cycling as the valve seeks a steady state position. Orifice 114 also restricts fluid flow into and out of pressure chamber 112 to prevent any resonant oscillation of the valve spool at critical pressure frequencies.

Leftward movement of the valve is initiated by an increase in fluid demand which decreases fluid pressure at the pump outlet. Decreased pressure at the pump outlet is communicated to the valve by line 26 and ultimately to chamber 112. Reducing the pressure in chamber 112 allows spring 51 to move sppol 44 leftward thereby reducing pressure in the crankcase and causing stroking of the pump pistons. For spool 44 to move leftward, fluid must flow to the pump outlet from chamber 112. In the case of a gradual pressure reduction fluid exists chamber 112 through orifice 114. However, when a sudden drop in output presure occurs, there is a high pressure differential between chambers 112 and 46. This pressure differential causes plate 60 to move leftward against spring 58 and off the end of sleeve 40 so that fluid pressure is rapidly relieved from chamber 112. In this manner, plate 60 and spring 58 perform the function of relief valve 35 shown in FIG. 1.

The control valve shown schematically as 12 in FIG. 1 and in detail in FIG. 3 offers all the advantages of relieving high pressure spikes, providing a high degree of control over the steady state region, and minimizing energy usage in the control circuit. Nevertheless, the control valve could be simplified to one of the type shown schematically as 12' in FIG. 2. A circuit using such a valve would still provide the advantages of dissipating high pressure spikes and a low gain region for improved valve control. However, the simplification of the valve to eliminate position II would be at the expense of increased energy usage.

Although this invention has been described using specific embodiments, it is readily appreciated that many alternatives, modifications and variations are possible in practicing this invention. Accordingly, this invention is intended to embrace all such possibilities that fall within the scope of the appended claims.

What is claimed is:

1. A control circuit for a reciprocating piston pump having a stroke control chamber for destroking said pump, by increasing the pressure in the stroke control chamber, to directly bias the pistons and vary displacement of the pistons, said circuit comprising:

a first passage communicating said stroke control chamber with the inlet of said pump;

a second passage communicating the outlet of said pump with said stroke control chamber;

a third passage communicating said first passage with said second passage; and means for blocking fluid flow in said second and third passages when the output pressure of said pump is below a first predetermined value and blocking fluid flow in said first and second passages when said output pressure is intermediate said first value and a second predetermined pressure value in excess of said first value.

2. The control circuit of claim 1 wherein said means for blocking flow includes a control valve said valve having a spool containing said third passage, a first position for blocking fluid flow through said second and third passages, a second position for blocking fluid flow in said second and third passages, and a third position allowing fluid flow through all of said passages.

3. A control circuit for a reciprocating piston pump having a stroke control chamber for destroking said pump by increasing the pressure in the stroke control chamber, to directly bias the pistons and vary displacement of the pistons, and sufficient fluid leakage from the piston chambers of the pump to the stroke control chamber to at least partially destroke the pump, said circuit comprising:

a first passage communicating said stroke control chamber with the inlet of said pump;

a second passage communicating pressurized fluid from said stroke control chamber to said pump inlet, said passage containing a flow restrictor;

a third passage communicating the outlet of said pump with said stroke control chamber; and means for blocking fluid communication across said first passage when output pressure from said pump exceeds a first predetermined value, blocking fluid communication across said third passage until output pressure exceeds a third predetermined value, said third value being intermediate said first and second values, and establishing fluid communication between said first and third passages when output pressure exceeds said second predetermined value.

4. A control circuit for a reciprocating piston pump having a stroke control chamber for destroking said pump by increasing the pressure in the stroke control chamber, to directly bias the pistons and vary displacement of the pistons, and sufficient fluid leakage from the piston chambers of the pump to the stroke control chamber to at least partially destroke the pump, said circuit comprising:

a first passage communicating said stroke control chamber with the inlet of said pump;

a control valve positioned across said first passage said control valve having a first position allowing unrestricted fluid communication across said first passage, a second position blocking fluid communication across said passage, fluid communication with the outlet of said pump via a second passage, and means for moving said valve from said first to said second position when fluid pressure at said outlet reaches a predetermined value; and a third passage communicating said stroke control chamber with said inlet, said passage containing a restrictor for increasing fluid pressure in said stroke control chamber when said valve is in said second position thereby destroking said pump.

5. The control circuit of claim 4 wherein said restrictor is an orifice.

6. The control circuit of claim 4 wherein said control valve has a third position for communicating fluid pressure from said outlet to said stroke control chamber and means for moving said valve to the third position when pressure at said outlet exceeds a predetermined pressure greater than the first mentioned predetermined pressure.

7. A control circuit for a reciprocating piston pump having a stroke control chamber for destroking said pump by increasing the pressure in the stroke control chamber, to directly bias the pistons and vary displacement of the pistons, and sufficient fluid leakage from the piston chambers of the pump to the stroke control chamber to at least partially destroke the pump, said circuit comprising:

a valve sleeve having a central bore, said bore having an inlet opening communicating with the inlet of said pump via a first passage, an outlet opening communicating with the outlet of said pump via a second passage and a stroke control opening communicating with the stroke control chamber of said pump via a third passage;

a valve member movably positioned in and cooperating with the walls of said bore having first, second, third and fourth positions, said valve member having means for communicating said inlet opening with said stroke chamber opening when in said first position, blocking fluid flow into or out of said stroke control opening when in said second position, communicating said outlet opening with said stroke control opening when in said third position, and communicating said outlet opening with said stroke control opening when in said third position, and communicating said outlet opening with said stroke control opening and said inlet opening and communicating said stroke control opening with said inlet opening when in said fourth position;

means for biasing said member to said first position;

means for moving said member progressively through said first, second, third and fourth positions in response to increasing pressure at said pump outlet;

a fourth passage communicating said pump inlet with said stroke control chamber; and a flow restrictor positioned across said fourth passage sized to increase pressure in said flow control chamber by an amount sufficient to cause destroking of said pump when said valve is in said second position.

8. The control circuit of claim 7 wherein said stroke control opening includes a V-notch portion and said means for communicating fluid from said outlet opening to said stroke control opening includes a recess on said valve member defined by at least one land, said land and groove cooperating with said V-notch to regulate said fluid communication in response to pressure from said outlet.

9. A control circuit for a reciprocating piston pump having a stroke control chamber for destroking said pump by increasing the pressure in the stroke control chamber, to directly bias the pistons and vary displacement of the pistons, and sufficient fluid leakage from the piston chambers of the pump to the stroke control chamber to at least partially destroke the pump, said circuit comprising:

a control valve, said control valve including:

(a) a sleeve having a central bore, first and second inlet ports spaced along said bore and communicating with said pump inlet via a first passage, an outlet port on said bore communicating with the outlet of said pump via second passage, a V-notch at one end of said bore communicating with the stroke control chamber of said pump via a third passage, a stroke control port on said bore communicating with said stroke control chamber via said third passage, and an annular recess;

(b) a spool slidably disposed within and cooperating with the walls of said bore, said spool having first, second, third and fourth annular grooves defined by first, second, third, fourth and fifth lands, and means for communicating fluid from said first groove to said fourth groove, said first groove communicating with said outlet port, said second annular groove communicating with at least one of said inlet ports, said third annular groove communicating with said stroke control port, and said spool being movable to a first position wherein said third groove also communicates with one of said inlet ports, a second position wherein said third and fifth lands block fluid communication across said stroke control port and said V-notch, a third position wherein said fourth groove communicates with said V-notch, and a fourth position wherein said first groove also communicates with one of said inlet ports, said second groove communicates with said third groove across said recess, and said fourth groove communicates with said V-notch opening;

(c) means for biasing said spool to said first position; and (d) means for progressively moving said spool through said first to said fourth positions against said biasing means in response to increasing pressure at said pump outlet;

a fourth passage communicating said pump inlet with said stroke control chamber; and a flow restrictor positioned across said fourth passage sized to increase pressure in said stroke control chamber by an amount sufficient to cause destroking of said pump when said valve is in said second position.

10. The control circuit of claim 9 wherein said control valve includes means for sensing pressure within said stroke control chamber and urging said spool to said first position in proportional response to fluid pressure within said chamber.

11. A stroke control valve for controlling the input and output of fluid of the stroke control chamber of a reciprocating piston pump and reducing pressure spikes from the piston pump, said pump being of the type that increased presure in the stroke control chamber directly biases the pistons to vary the displacement, said valve comprising:

a valve sleeve having a central bore, said bore having an inlet opening communicating with the inlet of said pump, an outlet opening communicating with the outlet of said pump and a stroke control opening communicating with the stroke control chamber of said pump;

a valve member movable positioned in and cooperating with the walls of said bore having first, second and third positions said valve member having means for communicating said inlet opening with said stroke chamber opening when in said first position, communicating said outlet opening with said stroke control chamber opening when in said second position, and communicating said outlet opening with said stroke control opening and said inlet opening, communicating said outlet opening and said stroke control opening with said inlet opening when in said third position;

means for biasing said member to said first position; and means for moving said valve member progressively through said first, second and third positions in response to increasing pressure at said pump outlet.

12. The stroke control valve of claim 11 wherein said stroke control opening includes a V-notch portion and said means for communicating fluid from said outlet opening to said stroke control opening includes a recess on said valve member defined by at least one land, said land and groove cooperating with said V-notch to regulate said fluid communication in response to pressure from said outlet.

13. The stroke control valve of claim 11 wherein said valve includes means for damping movement of said valve member.

14. A stroke control valve for controlling the input and output of fluid to or from the stroke control chamber of a reciprocating piston pump and reducing pressure spikes from the piston pump, said pump being of the type that increased pressure in the stroke control chamber directly biases the pistons to vary the displacement, said valve comprising:

a sleeve having a central bore having an inlet port communicating with the inlet of said pump, an outlet port communicating with the outlet of said pump, an outlet port communicating with the outlet of said pump, a V-notch at one end of said bore communicating with the stroke control chamber of said pump, a stroke control port communicating with said stroke control chamber and an annular recess;

a spool slidably disposed with said bore having first, second, third and fourth annular grooves defined by first, second, third, fourth and fifth lands, and means for communicating fluid from said first groove to said fourth groove, said first groove communicating with said outlet port, said second annular groove communicating with said inlet port, and said third annular groove communicating with said stroke control port, said spool being movable to a first position wherein said third groove also communicates with said inlet port, a second position wherein said third land only communicates with said stroke control port, a third position wherein said fourth groove communicates with said V-notch, and a fourth position wherein said first groove also communicates with said inlet port, said second grooves communicates with said third groove across said recess, and said fourth groove communicates with said V notch;

means for biasing said spool to said first position; and a variable volume chamber at the end of said bore opposite said V-notch partially defined by one end of said spool and in communication with the outlet of said pump via a fifth passage with pressure in said chamber urging said spool progressively against said biasing means into said second, third and fourth positions.

15. The stroke control valve of claim 14 wherein said fourth passageway comprises an orifice in said first land sized to damp movement of said spool.

16. The stroke control valve of claim 14 wherein said means for communicating fluid from said first groove to said fourth groove includes an internal bore in said spool.

17. A method for controlling the destroking of a reciprocating piston pump having a stroke control chamber for destroking said pump by increasing the pressure in the stroke control chamber, to directly bias the pistons and vary displacement of the pistons, and sufficient fluid leakage from the piston chambers of said pump to the stroke control chamber to at least partially destroke the pump, said method comprising:

sensing output pressure from said pump;

allowing unrestricted fluid flow from said stroke control chamber to the inlet of said pump while said output pressure remains at or below a predetermined value; and restricting fluid flow from said stroke control chamber when said output pressure exceeds said predetermined value by an amount sufficient to raise the pressure in said stroke control chamber to cause destroking of said pump.

18. The method of claim 17 wherein the pressure in said stroke control chamber is increased by fluid pressure from said pump outlet to further destroke said pump after said output pressure exceeds the first mentioned predetermined value by a predetermined amount.

* * * * *

UNITED STATES PATENT AND TRADEMARK OFFICE

CERTIFICATE OF CORRECTION

PATENT NO. : 4,648,803

DATED : 10 March 1987

INVENTOR(S) : Dwight Bruce Stephenson et al.

It is certified that error appears in the above-identified patent and that said Letters Patent is hereby corrected as shown below:

Col. 11, line 13, after "bore", insert -- , said bore --;
lines 14, 15 and 16, delete "an outlet port communicating with the outlet of said pump,";
line 38, delete "grooves" and insert -- groove --.

Signed and Sealed this

Fifteenth Day of March, 1988

*Attest:*

*Attesting Officer*

DONALD J. QUIGG

*Commissioner of Patents and Trademarks*